US010800163B2

(12) United States Patent
Yamada et al.

(10) Patent No.: US 10,800,163 B2
(45) Date of Patent: Oct. 13, 2020

(54) LIQUID EJECTING APPARATUS AND MOVING UNIT INCLUDING DETECTOR THAT DETECTS CHANGE IN POSTURE OF CARRIAGE

(71) Applicant: SEIKO EPSON CORPORATION, Tokyo (JP)

(72) Inventors: Tomonori Yamada, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/250,054

(22) Filed: Jan. 17, 2019

(65) Prior Publication Data

US 2019/0224965 A1 Jul. 25, 2019

(30) Foreign Application Priority Data

Jan. 19, 2018 (JP) ..... 2018-007034

(51) Int. Cl.

| | |
|---|---|
| ***B41J 2/045*** | (2006.01) |
| ***B41J 25/00*** | (2006.01) |
| ***B41J 2/14*** | (2006.01) |
| ***B41J 2/21*** | (2006.01) |

(52) U.S. Cl.

CPC ..... *B41J 2/04508* (2013.01); *B41J 2/04581* (2013.01); *B41J 2/14201* (2013.01); *B41J 2/2135* (2013.01); *B41J 25/006* (2013.01)

(58) Field of Classification Search

CPC .. B41J 2/04508; B41J 2/2135; B41J 2/04581; B41J 25/006; B41J 2/14201

See application file for complete search history.

(56) References Cited

U.S. PATENT DOCUMENTS

2004/0223027 A1 11/2004 Shinkawa et al.
2007/0097167 A1* 5/2007 Ishikawa ..... B41J 19/202 347/19

FOREIGN PATENT DOCUMENTS

| | | | |
|---|---|---|---|
| JP | 2007-118523 A | | 5/2007 |
| JP | 2013-126776 A | | 6/2013 |
| JP | 2015-136904 A | | 7/2015 |
| JP | 2015136904 A | * | 7/2015 |

* cited by examiner

*Primary Examiner* — Bradley W Thies

(74) *Attorney, Agent, or Firm* — Global IP Counselors, LLP

(57) ABSTRACT

A liquid ejecting apparatus includes: a support that extends in a second direction intersecting a first direction in which a printing medium is transported; a carriage that is connected to the support and is movable in the second direction; an ejector that is provided in the carriage and ejects a liquid to the printing medium; and a detector that is provided in the carriage and detects a change in posture of the carriage. In a case where the liquid is not ejected from the ejector, the carriage moves in the second direction, and the detector detects the change in posture of the carriage. The detector outputs posture-change amount information based on the change in posture of the carriage. Ejection of the liquid is corrected based on the posture-change amount information.

6 Claims, 8 Drawing Sheets

LIQUID EJECTING APPARATUS AND MOVING UNIT INCLUDING DETECTOR THAT DETECTS CHANGE IN POSTURE OF CARRIAGE

This application claims priority to Japanese Patent Application No. 2018-007034 filed on Jan. 19, 2018. The entire disclosure of Japanese Patent Application No. 2018-007034 is hereby incorporated herein by reference.

BACKGROUND

1. Technical Field

The present invention relates to a liquid ejecting apparatus, which includes a head unit that ejects a liquid, and a moving unit.

2. Related Art

For example, in a liquid ejecting apparatus such as an ink jet printer, a posture change (displacement of posture) of a carriage provided with an ejector of an ink can be exemplified as one of causes of deterioration of image-forming accuracy (for example, an occurrence of distortion in an image).

Specifically, when the posture change occurs in the carriage, a distance between the ejector of an ink and recording paper or an ejection direction of ink is likely to change, and thus the ink does not land at a predetermined landing position. Consequently, the image-forming accuracy is likely to deteriorate.

For example, with consideration for such a circumstance, JP-A-2007-118523 proposes the following technology. In other words, in JP-A-2007-118523, a liquid ejecting apparatus includes a gyro sensor that detects an angular velocity around a predetermined axis of a carriage, and a change in posture of the carriage can be detected, based on the angular velocity detected by the gyro sensor.

Incidentally, a carriage in a printer is movably supported by a support, and thus manufacture accuracy or attachment accuracy of the support influences a posture of the carriage. In particular, a large printer called a large format printer (LFP) has a long transport route (movement distance) of the carriage, and thus eccentricity or an attachment error of the support is highly likely to cause a three-dimensional posture change of the carriage.

In addition, a change in shape of the support due to aged deterioration or an environmental change such as a temperature change or humidity change is likely to occur in the large printer. Here, it is not practical to design the support with consideration for the environmental change in advance, because an initial transport route is likely to be distorted, and initial image-forming accuracy is likely to significantly deteriorate.

As described above, a problem related to the posture change of the carriage is particularly prominent in the large printer such as the LFP. In order to solve the problem, it is preferable to detect the posture change of the carriage in real time and to perform correction control based on a detection result of the posture change. Here, the posture change of the carriage is an abnormally minute change, in many cases, and thus it is necessary to perform the detection thereof with high accuracy.

From a viewpoint of detecting the posture change of the carriage (liquid ejector) with high accuracy, it is desirable to mount the gyro sensor on the carriage. However, an ink ejection signal (high-voltage pulse) that is applied to an ink ejecting head influences, as electromagnetic noise, detection by the gyro sensor and/or a detection signal that is transmitted from the gyro sensor, in some cases. In this case, the posture change of the carriage is not normally detected by the gyro sensor and, as a result, it is difficult to normally correct the posture change of the carriage.

In addition, when the number of ink ejecting nozzles increases for a purpose of high-speed printing, the number of corresponding piezoelectric elements also increases, the ink ejection signal that is applied to the ink ejecting head also increases, and thus the electromagnetic noise influences the gyro sensor to a remarkable extent.

SUMMARY

An advantage of some aspects of the invention is to enhance detection accuracy of a posture change of a carriage so as to suppress degradation of high-quality printing or high-speed printing.

APPLICATION EXAMPLE 1

According to an aspect of the invention, there is provided a liquid ejecting apparatus including: a support that extends in a second direction intersecting a first direction in which a printing medium is transported; a carriage that is connected to the support and is movable in the second direction; an ejector that is provided in the carriage and ejects a liquid to the printing medium; and a detector that is provided in the carriage and detects a change in posture of the carriage. In a case where the liquid is not ejected from the ejector, the carriage moves in the second direction, and the detector detects the change in posture of the carriage. The detector outputs posture-change amount information based on the change in posture of the carriage, and ejection of the liquid is corrected based on the posture-change amount information.

In this configuration, in a case where the liquid is not ejected from the ejector provided in the carriage that is movable along the support, the detector detects the posture-change amount information depending on the posture change (for example, displacement, wobbling, or the like) of the carriage. Then, the ejection of the liquid is corrected depending on the posture-change amount information. Hence, it is possible to suppress an influence of noise (for example, electromagnetic noise due to the above-described ink ejection signal) which is generated in a case where the liquid is ejected, and enhancement of detection accuracy is realized.

APPLICATION EXAMPLE 2

In the liquid ejecting apparatus, the detector may detect the change in posture of the carriage, before the liquid is ejected to the printing medium.

In this configuration, since the liquid ejection as a result of correction of the posture change of the carriage is prepared before a printing operation, there is no need to perform a high-speed process, compared to a case where correction is performed during the printing operation. Hence, there is no need to provide hardware for realizing a high-speed correction process of the liquid ejection during the printing operation.

Furthermore, correction of the posture change is performed before the printing operation, and thereby the printing operation is not interrupted when the posture change of the carriage is detected and the liquid ejection is corrected. Therefore, it is possible to perform higher-speed printing.

APPLICATION EXAMPLE 3

In the liquid ejecting apparatus, a controller that generates a printing control signal for controlling ejection of the liquid from the ejector is further included. The ejector may have a piezoelectric element that performs an operation of ejecting the liquid. The controller may change at least any one of timing of the ejection, a speed of a liquid droplet related to the ejection, an amount of one liquid droplet related to the ejection, a total amount of liquid droplets related to the ejection, the ejector that performs the ejection, and voltage that is applied to the piezoelectric element, based on the posture-change amount information from the detector.

In this configuration, since an ejection state of the liquid by the ejector is changed depending on the posture change of the carriage, deterioration of image-forming accuracy due to the posture change of the carriage is suppressed, and improvement of an image quality is realized.

APPLICATION EXAMPLE 4

In the liquid ejecting apparatus, the printing control signal may be input to the detector.

In this configuration, it is possible to determine an ejection situation of the liquid is determined from the printing control signal from the controller, and it is possible for the detector to detect the posture change of the carriage in a non-ejection state of the liquid. Hence, it is possible to execute detection reliably in the non-ejection state of the liquid.

APPLICATION EXAMPLE 5

In the liquid ejecting apparatus, the detector may be provided at a position at which a shortest distance between the detector and the support is longer than a shortest distance between a gravity center of the carriage and the support.

In this configuration, the detector is disposed at a position separated from the support by a distance longer than the distance between the gravity center of the carriage and the support. For example, the position means a position at which a change amount of the posture change of the carriage with the support as a rotation axis is larger. Hence, the detector is disposed at the position, thereby, it is also possible to detect a minute posture change of the carriage, and the enhancement of detection accuracy is realized.

APPLICATION EXAMPLE 6

In the liquid ejecting apparatus, the ejector may have a nozzle plate provided with an ejection opening for ejecting the liquid by the ejector, and the detector may be provided at a position at which the shortest distance between the detector and the nozzle plate is shorter than a shortest distance between a gravity center of the carriage and the nozzle plate.

In this configuration, it is preferable to detect a posture change related to a part in which an ejection opening of the liquid is formed, and thus the detector is disposed at a position closer to the nozzle plate provided with the ejection opening of the liquid than to the gravity center of the carriage. Therefore, it is possible to detect a change in distance between the printing medium and the ejection opening with higher accuracy.

APPLICATION EXAMPLE 7

According to another aspect of the invention, there is provided a moving unit including: a carriage that is movable in a second direction intersecting a first direction in which a printing medium is transported; an ejector that is provided in the carriage and ejects a liquid to the printing medium; and a detector that is provided in the carriage and detects a change in posture of the carriage. In a case where the liquid is not ejected from the ejector, the carriage moves in the second direction, and the detector detects the change in posture of the carriage. The detector outputs posture-change amount information based on the change in posture of the carriage, and ejection of the liquid is corrected based on the posture-change amount information.

In this configuration, in a case where the liquid is not ejected from the ejector provided in the carriage that is movable along the support, the detector detects the posture-change amount information depending on the posture change (for example, displacement, wobbling, or the like) of the carriage. Then, the ejection of the liquid is corrected depending on the posture-change amount information. Hence, it is possible to suppress an influence of noise (for example, electromagnetic noise due to the above-described ink ejection signal) which is generated in a case where the liquid is ejected, and enhancement of detection accuracy is realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
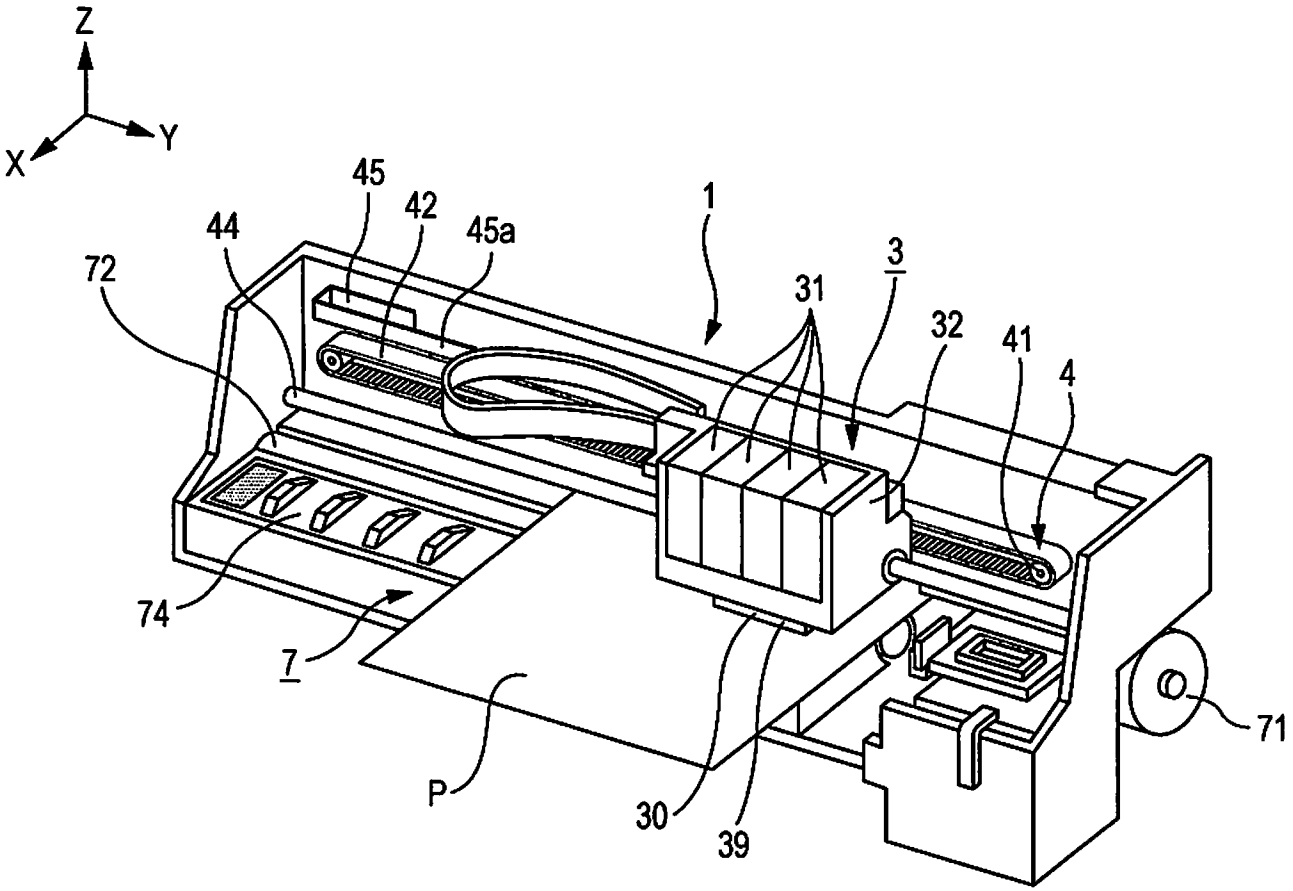
FIG. 1 is a perspective view illustrating a schematic configuration of an ink jet printer according to an embodiment of the invention.

Hereinafter, embodiments of the invention will be described with reference to the drawings. However, in the drawings, dimensions and scales of members are appropriately different from actual dimensions and scales. In addition, the embodiments to be described below are preferred specific examples of the invention, and thus various types of technically preferable limitations are provided; however, the scope of the invention is not limited to the embodiment unless there is particular description indicating a limitation to the invention in the following description.

A. Embodiments

In the embodiment, an ink jet printer that ejects ink to recording paper P (printing medium) so as to form an image on the recording paper P is exemplified and described as a liquid ejecting apparatus.

Figure 2:
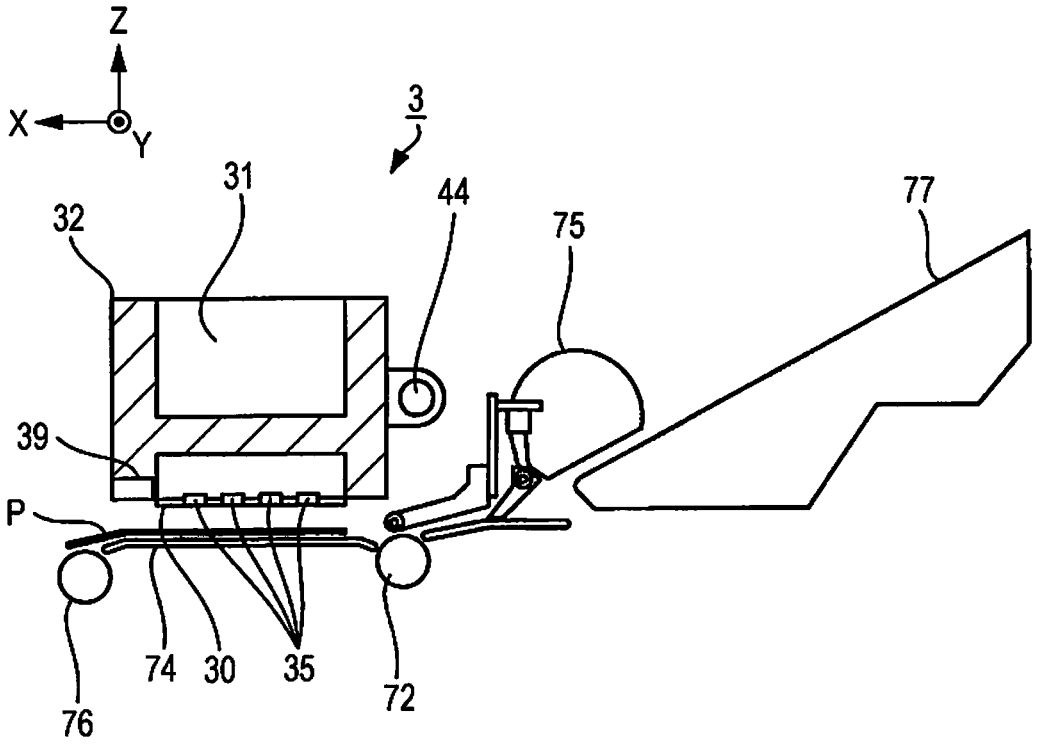
FIG. 2 is a sectional view of a main part of the schematic configuration of the ink jet printer.

Hereinafter, a configuration of an ink jet printer 1 according to the embodiment will be described with reference to FIGS. 1 and 2. FIG. 1 is a perspective view schematically illustrating an internal configuration of the ink jet printer 1. In addition, FIG. 2 is a sectional view of a main part of the schematic configuration of the ink jet printer 1.

As illustrated in FIG. 1, the ink jet printer 1 includes a moving unit 3 that reciprocates in a main scanning direction (a Y-axis direction in FIG. 1) and a carriage guide shaft 44 (support). The moving unit 3 includes at least a carriage 32, ejectors 35 (refer to FIG. 2), a gyro sensor 39, and an angular velocity information processor 91 (refer to FIG. 3). The gyro sensor 39 and the angular velocity information processor 91 constitute a "detector" in the embodiment.

The carriage 32 is configured to be capable of mounting the predetermined number (in the example, four) ink cartridges 31. In the example, the four ink cartridges 31 corresponding to four colors of yellow, cyan, magenta, and black are mounted on the carriage 32, and the ink cartridges 31 are filled with corresponding color inks (liquids), respectively.

A head unit 30 connected to the carriage 32 includes M ejectors 35. Here, M is a natural number of 2 or larger. In addition, to the head unit 30, a drive signal for controlling an ejection amount of the ink and a control signal for controlling ejection from nozzles N (refer to FIG. 4) are input. Insides of the ejectors 35 are filled with inks supplied from the ink cartridges 31, and the filled ink is ejected from the nozzle N. Each of the M ejectors 35 receives supply of the ink from any one of the four ink cartridges 31. Consequently, it is possible to eject overall four color inks from the M ejectors 35, and full-color printing is realized.

The ink jet printer 1 according to the embodiment includes the four ink cartridges 31 corresponding to the four color inks described above; however, the invention is not limited thereto, and the ink jet printer may further include an ink cartridge 31 filled with another color ink other than the four color inks or may include only ink cartridges 31 corresponding to some colors of the four colors.

The moving unit 3 is caused to reciprocate in the main scanning direction (Y-axis direction) by a moving mechanism 4. The moving mechanism 4 includes a carriage motor 41, which is a drive source that causes the moving unit 3 to reciprocate, and the carriage guide shaft 44 of which both ends are fixed to a housing of the ink jet printer 1. In addition, the moving mechanism 4 further includes a timing belt 42, which extends parallel to the carriage guide shaft 44 and is driven by the carriage motor 41, and a carriage motor driver 43 (refer to FIG. 3) that drives the carriage motor 41.

The carriage 32 of the moving unit 3 is reciprocably supported by the carriage guide shaft 44 of the moving mechanism 4 and is fixed to a part of the timing belt 42. Therefore, when the carriage motor 41 causes the timing belt 42 to run forward and in reverse, the moving unit 3 is guided to reciprocate by the carriage guide shaft 44.

In addition, the moving mechanism 4 includes a linear encoder 45 that detects a position of the moving unit 3 in the main scanning direction (Y-axis direction). The linear encoder 45 has a scale 45*a* printed as a striped pattern with predetermined intervals in the main scanning direction. In addition, although not illustrated, a photo-interrupter configured of a pair of a light-emitting element and a light-receiving element is disposed on a side of the linear encoder 45 of the carriage 32.

The gyro sensor 39 is a sensor that detects angular velocities around three axes orthogonal to each other, respectively, and outputs angular velocity information and is provided at a "specific position" in the moving unit 3. It is possible to use various types of angular velocity detectors as the gyro sensor 39.

In the example, the three axes as detection targets of the angular velocity by the gyro sensor 39 are an X axis; a Y axis, and a Z axis illustrated in FIG. 1. Here, the X-axis direction (first direction) is a sub-scanning direction of the ink jet printer 1 (a transport direction of the recording paper P). The Y-axis direction (second direction) is the main scanning direction of the ink jet printer 1. The Z-axis direction is a normal direction of a nozzle plate 240 (refer to FIG. 4) to be described below (a normal direction to a recording surface of the recording paper P).

In order to prevent deterioration of image-forming accuracy due to a posture change of the carriage 32, it is desirable that the ink jet printer 1 employ a technology in which the posture change can be detected with high accuracy.

However, since a change amount related to the posture change of the carriage 32 is a minute amount, it is difficult to detect the posture change of the carriage with high accuracy only by simply providing the gyro sensor 39 in the carriage 32.

In addition, the drive signal or the control signal (hereinafter, collectively referred to as an "ink ejection signal") which are input to the head unit 30 includes a high-voltage pulse signal, in some cases. In a case where the ink ejection signal is input to the head unit 30, the ink ejection signal has, as electromagnetic noise, a bad influence on detection by the gyro sensor 39 or a detection signal that is transmitted from the gyro sensor 39, in some cases. In this case, the posture change of the carriage 32 is not normally detected by the gyro sensor 39 and, as a result, it is difficult to normally correct the posture change of the carriage 32.

When the number of nozzles N increases for a purpose of high-speed printing, the number of corresponding drive elements (for example, stacked piezoelectric elements 201 to be described below) also increases, the ink ejection signal that is input to the head unit 30 also increases, and thus the electromagnetic noise influences the gyro sensor 39 to a remarkable extent.

In the ink jet printer 1 according to the embodiment, the carriage 32 is caused to perform scanning movement in a state in which the ink is not ejected from the ejector 35 of the head unit 30, the gyro sensor 39 to be described below detects the posture change of the carriage 32, and posture-change amount information corresponding to a scanning position is stored in a storage unit 62. Then, correction calculated based on the posture-change amount information is reflected in printing, and thereby it is possible to detect the posture change with high accuracy.

In addition, the gyro sensor 39 is provided at the "specific position" in the moving unit 3, and thereby it is possible to further enhance the detection accuracy of the posture change of the carriage 32. The "specific position" will be described in detail below.

As illustrated in FIG. 2, the ink jet printer 1 includes a paper feed mechanism 7 that supplies and discharges the recording paper P. The paper feed mechanism 7 includes a paper feed motor 71 (refer to FIGS. 1 and 3) which is a drive source, a paper feed motor driver 73 (refer to FIG. 3) that drives the paper feed motor 71, a tray 77 on which the recording paper P is set, and a discharge port (not illustrated) that discharges the recording paper P. In addition, the paper feed mechanism 7 includes a platen 74 that is provided below (a −Z direction) the head unit 30, paper feed rollers 72 and 75 that rotate along an operation of the paper feed motor 71 so as to feed the recording paper P one by one to the platen 74, and a paper discharge roller 76 that rotates along with the operation of the paper feed motor 71 so as to transport the recording paper P on the platen 74 to the discharge port (not illustrated).

Figure 3:
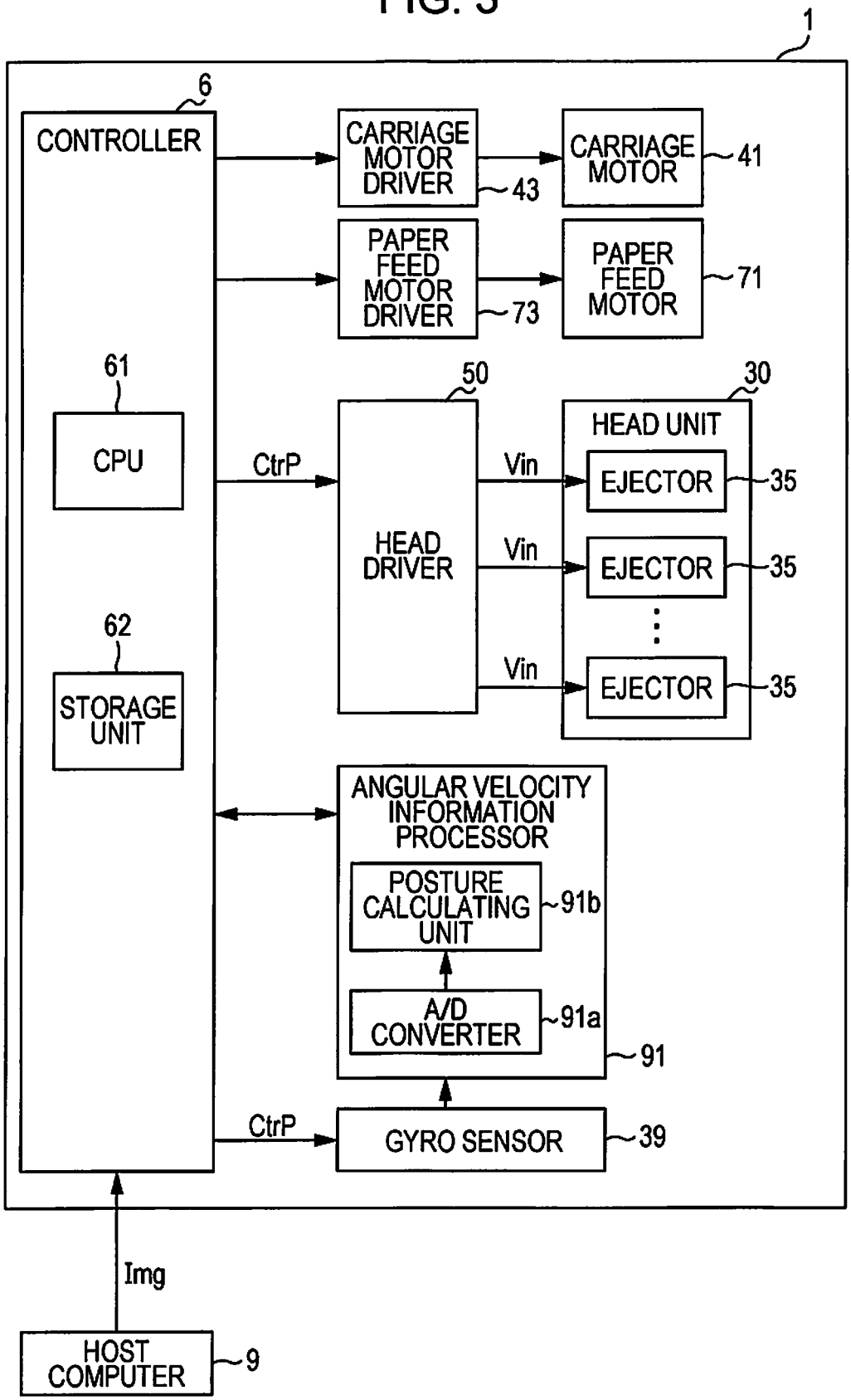
FIG. 3 is a block diagram illustrating a configuration of a system of the ink jet printer.

FIG. 3 is a functional block diagram illustrating a configuration of a system of the ink jet printer 1 according to an embodiment of the invention. As illustrated in FIG. 3, the ink jet printer 1 includes a head driver 50 that drives the head unit 30, the carriage motor driver 43 that drives the carriage motor 41, the paper feed motor driver 73 that drives the paper feed motor 71, a controller 6, and the angular velocity information processor 91, in addition to constitutional members illustrated in FIGS. 1 and 2.

The angular velocity information processor 91 calculates rotation angles (change amounts of posture) around the axes from angular velocity information that is detected by the gyro sensor 39. In other words, the gyro sensor 39 and the angular velocity information processor 91 operate as detectors that detect the posture change of the carriage 32 and output the posture-change amount information. Specifically, the angular velocity information processor 91 includes an A/D converter 91*a* and a posture calculating unit 91*b*. The A/D converter 91*a* converts the angular velocity information (analog voltage) output from the gyro sensor 39 into digital data and outputs the digital data to the posture calculating unit 91*b*. The posture calculating unit 91*b* calculates the rotation angles around the axes (change amounts of posture) from the digital data output from the A/D converter 91*a*. Then, the posture calculating unit 91*b* generates the posture-change amount information indicating the rotation angles around the axes (change amounts of posture) so as to output the information to the controller 6. With the calculation, a known calculation method by those skilled in the art may be used. The posture-change amount information is used in control of the head driver 50 or the like by the controller 6 to be described below.

The controller 6 includes a CPU 61 and the storage unit 62 and collectively controls operations of the members of the ink jet printer 1.

For example, the storage unit 62 includes an electrically erasable programmable read-only memory (EEPROM) as a type of non-volatile semiconductor memory, a random access memory (RAM), and a PROM as a type of non-volatile semiconductor memory. In a data storing region of the EEPROM, image data Img that is supplied from a host computer 9 via an interface (not illustrated) is stored. Data necessary when various processes such as a printing process is executed is temporarily stored in the RAM, and a control program for executing the various processes such as the printing process is temporarily evolved. In addition, the posture-change amount information of the carriage 32, which is output from the angular velocity information processor 91, based on the angular velocity detected by the gyro sensor 39 is stored in the RAM, for example. A control program or the like for controlling the members of the ink jet printer 1 is stored in the PROM. The EEPROM, the RAM, and the PROM are an example, and it is possible to appropriately select a semiconductor memory that is used in the storage unit 62.

The CPU 61 stores the image data Img that is supplied from the host computer 9 in the storage unit 62. In addition, the CPU 61 controls an operation of the head driver 50 and generates and outputs a printing control signal CtrP for driving the ejectors 35, based on various types of data such as the image data Img, which are stored in the storage unit 62. Furthermore, in order to define timing of a detection operation of the posture change of the carriage 32 by the gyro sensor 39, the CPU 61 outputs the printing control signal CtrP to the gyro sensor 39, too.

In addition, the CPU 61 generates a control signal for controlling an operation of the carriage motor driver 43 and a control signal for controlling an operation of the paper feed motor driver 73 based on the various types of data that are stored in the storage unit 62 and outputs various types of generated control signals.

Furthermore, the CPU 61 controls the head driver 50 such that the ejectors 35 is caused to eject the ink in an ejection state according to the posture-change amount information described above. Specifically, the CPU 61 controls the head driver 50 based on the posture-change amount information so as to cancel "displacement of a landing position of the ink" due to the "posture change of the carriage 32".

For example, the CPU 61 controls the head driver 50 to change at least any one of timing of the ejection by the ejector 35, a speed of a liquid droplet related to the ejection, an amount of one liquid droplet related to the ejection, a total amount of liquid droplets related to the ejection, the ejector 35 that performs the ejection, and voltage that is applied to the piezoelectric element 200 (stacked piezoelectric element 201).

Specifically, the controller 6 controls the paper feed motor 71 via the paper feed motor driver 73 such that the recording paper P is intermittently fed one by one in the sub-scanning direction (X-axis direction) and controls the carriage motor 41 via the carriage motor driver 43 such that the moving unit 3 reciprocates in the main scanning direction (Y-axis direction) intersecting a feeding direction (X-axis direction) of the recording paper P. In addition, simultaneously, the controller 6 controls an ejection amount and ejection timing of the ink from the ejectors 35 via the head driver 50.

The controller 6 is configured as described above, controls the moving mechanism 4, the paper feed mechanism 7, the head driver 50, or the like based on the image data Img input from the host computer 9 such as a personal computer or a digital camera, and executes the printing process of forming an image according to the image data Img on the recording paper P.

The controller 6 may execute a process of transmitting an error message or information of abnormal ejection to the host computer 9 as necessary.

The head driver 50 generates a drive signal Vin for driving the ejectors 35 included in the head unit 30, based on the printing control signal CtrP that is output by the controller 6.

Hereinafter, with reference to FIGS. 4 and 5, configurations of the head unit 30 and the ejectors 35 included in the head unit 30 will be described.

Figure 4:
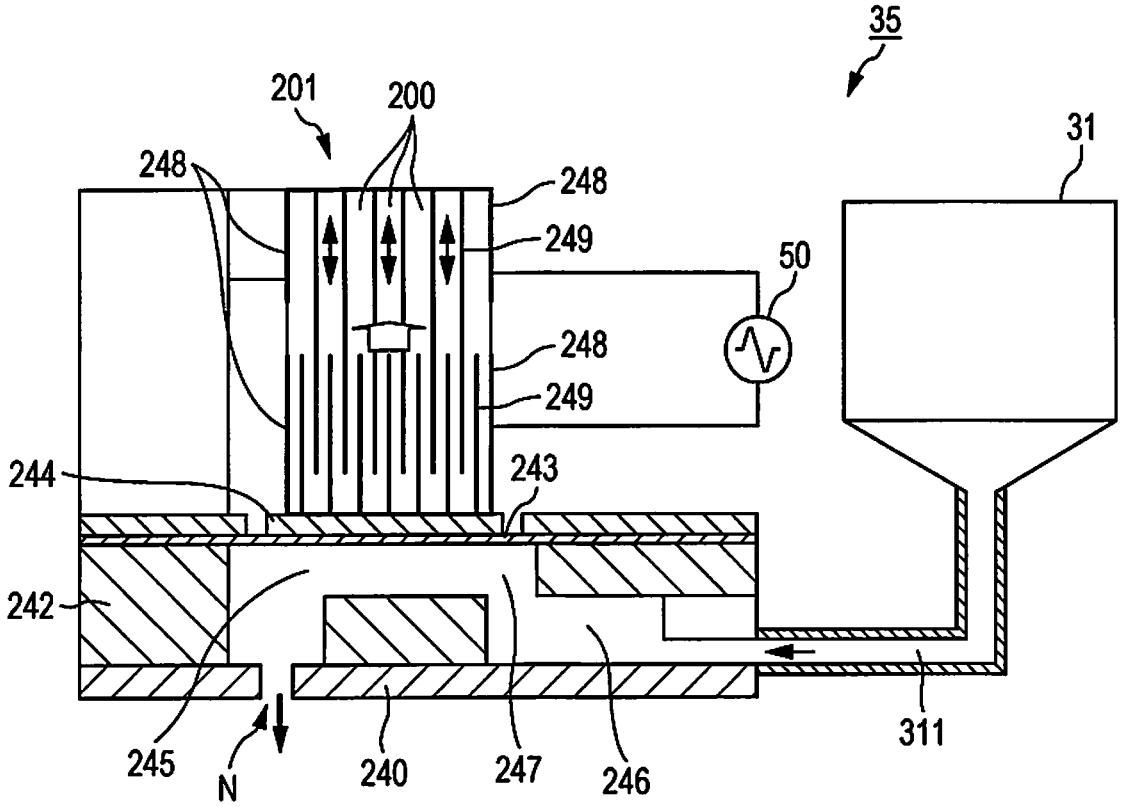
FIG. 4 is a sectional view illustrating an example of a schematic configuration of an ejector.

FIG. 4 is a sectional view illustrating a schematic configuration of each of the ejectors 35 included in the head unit 30. As illustrated in FIG. 4, the ejector 35 is provided the nozzle N that ejects the ink in a cavity 245 by driving the piezoelectric elements 200. The ejector 35 includes the nozzle plate 240 provided with the nozzles N, a cavity plate 242, a vibration plate 243, and the stacked piezoelectric element 201 in which a plurality of piezoelectric elements 200 are stacked.

The cavity plate 242 is formed into a predetermined shape (shape to be provided with a recessed portion), and thereby the cavity 245 and a reservoir 246 are formed. The cavity 245 and the reservoir 246 communicate with each other via an ink supply opening 247. In addition, the reservoir 246 communicates with the ink cartridge 31 via an ink supply tube 311.

In FIG. 4, a lower end of the stacked piezoelectric element 201 is bonded to the vibration plate 243 via an intermediate layer 244. A plurality of external electrodes 248 and internal electrodes 249 are bonded to the stacked piezoelectric element 201. In other words, the external electrodes 248 are bonded to an external surface of the stacked piezoelectric element 201, and the internal electrodes 249 are disposed between the piezoelectric elements 200 (or insides of the piezoelectric elements) constituting the stacked piezoelectric element 201. In this case, some of the external electrodes 248 and the internal electrodes 249 are disposed alternately so as to overlap each other in a thickness direction of the piezoelectric element 200.

Then, the drive signal Vin transmitted by the head driver 50 is supplied between the external electrodes 248 and the internal electrodes 249, and thereby the stacked piezoelectric element 201 is vibrated to is deformed (expanded and contracted in a vertical direction in FIG. 4) as illustrated by an arrow in FIG. 4, and the vibration plate 243 is vibrated due to the vibration of the stacked piezoelectric element. A volume of the cavity 245 (pressure in the cavity) changes due to the vibration of the vibration plate 243, and the ink, with which the cavity 245 is filled, is ejected from the nozzle N.

In a case where the ink in the cavity 245 is decreased due to the ejection of the ink, an ink is supplied from the reservoir 246. In addition, the ink is supplied to the reservoir 246 from the ink cartridge 31 via the ink supply tube 311.

Figure 5:
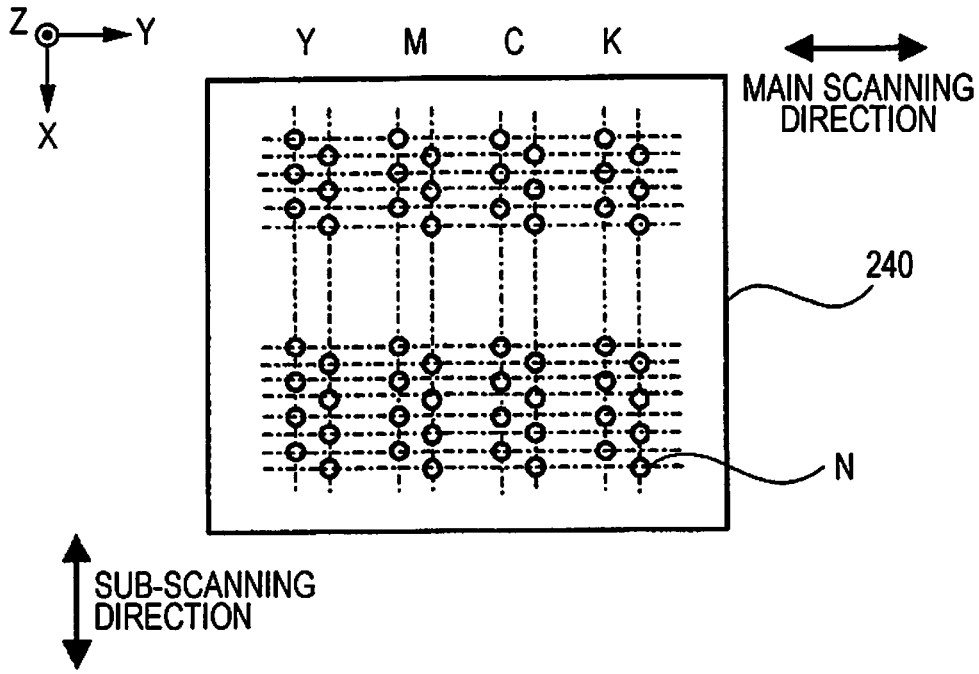
FIG. 5 is a view illustrating a schematic configuration of a nozzle plate included in the ejector.

In an arrangement pattern of the nozzles N formed in the nozzle plate 240 illustrated in FIG. 4, columns of the nozzles are displaced as in a nozzle arrangement pattern illustrated in FIG. 5, for example. In addition, pitches between the nozzles N can be appropriately set depending on printing resolution (dpi: dot per inch). FIG. 5 illustrates an arrangement pattern of the nozzles N in a case where the four color inks (ink cartridges) are applied.

Next, another example of the ejector will be described. The ink jet printer 1 according to the embodiment may be configured to include an ejector 35A illustrated in FIG. 6, instead of the ejectors 35.

Figure 6:
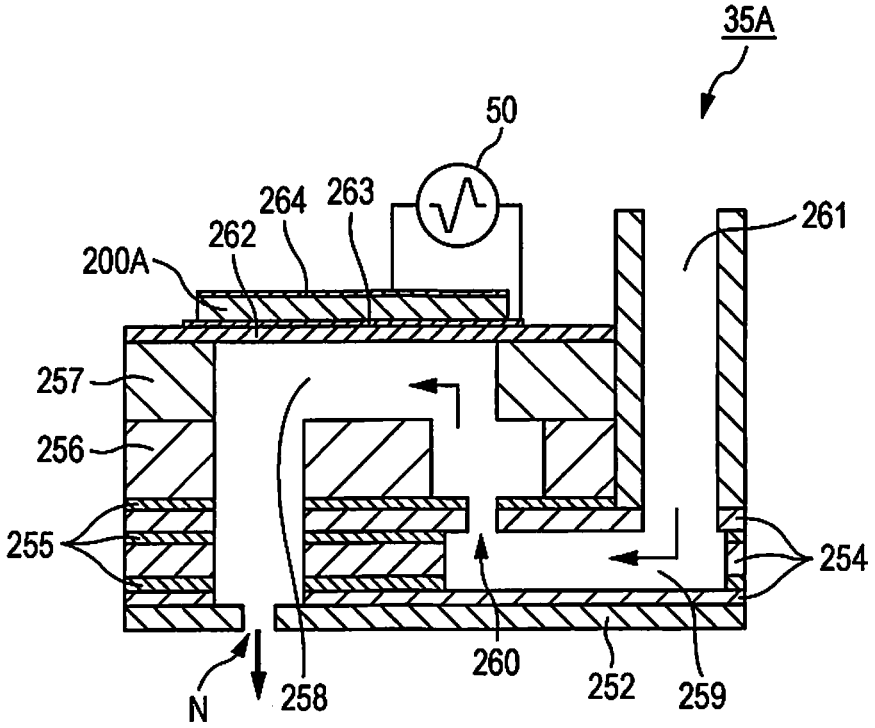
FIG. 6 is a sectional view illustrating another example of a schematic configuration of an ejector.

A vibration plate 262 is vibrated due to the drive of a piezoelectric element 200A, and the ejectors 35A illustrated in FIG. 6 eject the ink in a cavity 258 from the nozzle N. A metal plate 254 made of stainless steel is bonded to a nozzle plate 252 made of stainless steel provided with the nozzles N via an adhesive film 255, and the metal plate 254 made of stainless steel is bonded thereon via the adhesive film 255. Then, a communication opening formed plate 256 and a cavity plate 257 are sequentially bonded.

The nozzle plate 252, the metal plate 254, the adhesive film 255, the communication opening formed plate 256, and the cavity plate 257 are formed into a predetermined shape (shape to be provided with a recessed portion), and the cavity 258 and a reservoir 259 are formed by overlapping the plates and the film. The cavity 258 and the reservoir 259 communicate with each other via an ink supply opening 260. In addition, the reservoir 259 communicates with an ink inlet 261.

The vibration plate 262 is provided on a top opening portion of the cavity plate 257, and the piezoelectric element 200A is bonded to the vibration plate 262 via a lower electrode 263. In addition, an upper electrode 264 is bonded to the piezoelectric element 200A on an opposite side to the lower electrode 263. The head driver 50 supplies the drive signal Vin between the upper electrode 264 and the lower electrode 263, thereby vibrating the piezoelectric element 200A, and vibrating the vibration plate 262 bonded to the piezoelectric element 200A. A volume of the cavity 258 (pressure in the cavity) changes due to the vibration of the vibration plate 262, and the ink, with which the cavity 258 is filled, is ejected from the nozzle N.

In a case where an ink is ejected, and thus an amount of ink in the cavity 258 is decreased, an ink is supplied from the reservoir 259. In addition, an ink is supplied to the reservoir 259 via the ink inlet 261.

Next, ejection of the ink in the ejector 35 (ejector 35A) will be described with reference to FIGS. 7A to 7C.

Figure 7A:
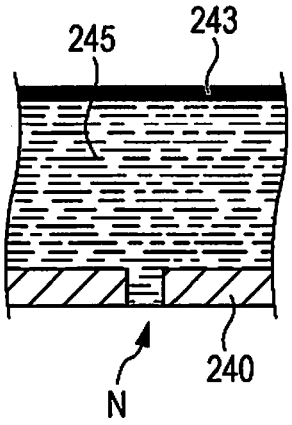
FIG. 7A is a sectional view for describing an example of the ejector during supply of a drive signal.
Figure 7B:
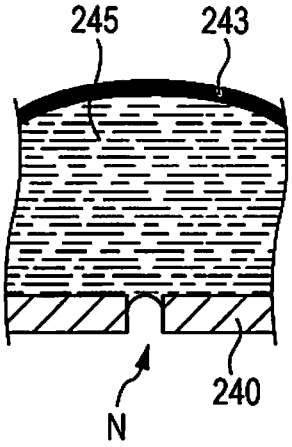
FIG. 7B is a sectional view for describing another example of the ejector during supply of another drive signal.
Figure 7C:
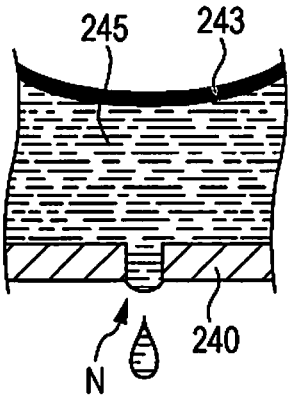
FIG. 7C is a sectional view for describing still another example of the ejector during supply of still another drive signal.

When the drive signal Vin is supplied to the piezoelectric element 200 (200A) illustrated in FIG. 4 (FIG. 6) from the head driver 50, a Coulomb force is generated between the electrodes, the vibration plate 243 (262) is curved upward in FIG. 4 (FIG. 6) from an initial state illustrated in FIG. 7A, and the volume of the cavity 245 (258) increases as illustrated in FIG. 7B. In this state, when the voltage indicated by the drive signal Vin changes by the control of the head driver 50, the vibration plate 243 (262) is restored by an elastic restoring force thereof is moved downward by passing a position of the vibration plate 243 (262) in the initial state, and the volume of the cavity 245 (258) is rapidly contracted as illustrated in FIG. 7C. At that time, a compression pressure generated in the cavity 245 (258) causes a part of the ink, with which the cavity 245 (258) is filled, to be ejected as ink droplets from the nozzles N that communicate with the cavity 245 (258).

Hereinafter, the "specific position" in the moving unit 3, at which the gyro sensor 39 is provided, will be described in detail with reference to FIGS. 8 and 9. In addition, timing for detecting the posture change of the carriage 32 by the gyro sensor 39 will be described in detail with reference to FIG. 3.

Figure 8:
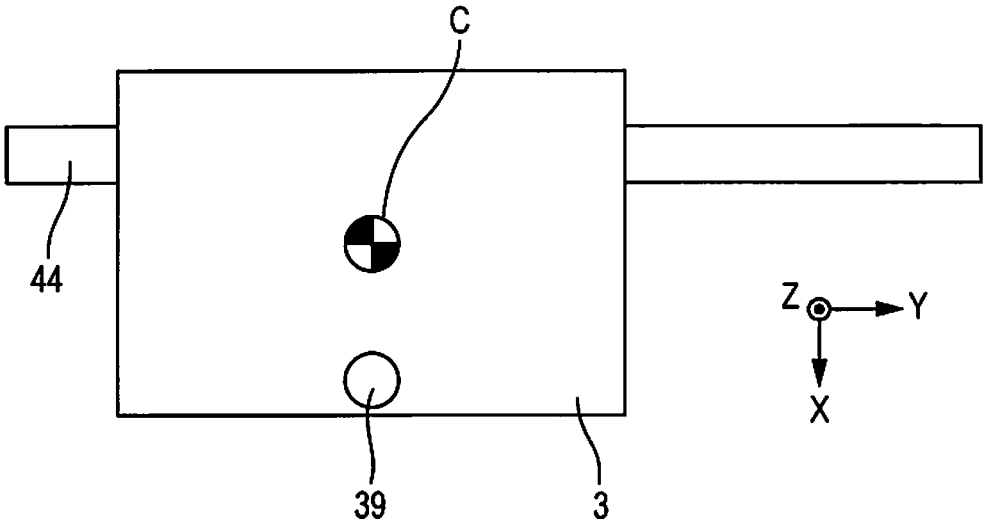
FIG. 8 is a schematic view illustrating a disposing position of a gyro sensor in an X-axis direction and a Y-axis direction.

FIG. 8 is a schematic view illustrating a disposing position of the gyro sensor 39 in the X-axis direction (sub-scanning direction) and the Y-axis direction (main scanning direction). FIG. 9 is a schematic view illustrating the disposing position of the gyro sensor 39 in the X-axis direction (sub-scanning direction) and the Z-axis direction.

In general, a "distance" means a length of a straight line (that is, the shortest route) that connects a point with a point. In addition, a distance between a point and a straight line or a plane is found as the shortest distance of distances between the point and a point on the straight line or the plane.

Here, a distance between objects having a three-dimensional shape is found as a length of the shortest straight line of straight lines that connect any point on a surface of one object with any point on a surface of the other object (that is, straight lines that connect any points on surfaces of both objects to each other).

Hence, the shortest distance between the objects having the three-dimensional shape is uniquely set as a length of the shortest straight line of straight lines that connect any point on a surface of one object with any point on a surface of the other object.

In the embodiment, the disposing position of the gyro sensor 39 is a position that satisfies at least the following condition. In other words, the disposing position of the gyro sensor 39 is a position at which the shortest distance between the gyro sensor 39 and the carriage guide shaft 44 is longer than the shortest distance between the gravity center C of the carriage 32 and the carriage guide shaft 44. Here, a position of the gravity center C of the carriage 32 is identified from a structure or the like of the carriage 32, for example, and the shortest distance from the gravity center C to the carriage guide shaft 44 is identified as a length (hereinafter, referred to as a distance L) of the shortest straight line of straight lines that connect the gravity center C with any points on a surface of the carriage guide shaft 44. Hereinafter, the best disposing position of the gyro sensor 39 and the axis directions will be described in detail.

Position in X-Axis Direction (Sub-Scanning Direction)

Figure 9:
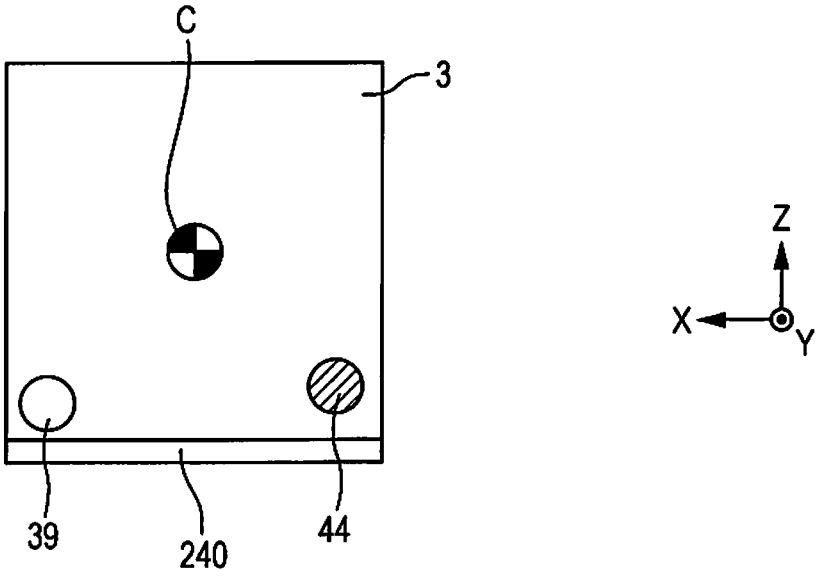
FIG. 9 is a schematic view illustrating the disposing position of the gyro sensor in the X-axis direction and a Z-axis direction.

The gyro sensor 39 is provided, in the X-axis direction (sub-scanning direction), at a position at which the shortest distance between the gyro sensor 39 and the carriage guide shaft 44 is longer than the shortest distance between the gravity center C of the carriage 32 and the carriage guide shaft 44 as illustrated in FIGS. 8 and 9.

Here, the carriage 32 is supported to be movable in the Y-axis direction by the carriage guide shaft 44, and thus a displacement amount when the posture change of the carriage 32 occurs increases as a position thereof is separated from the carriage guide shaft 44 in the X-axis direction (sub-scanning direction).

In the example, the gyro sensor 39 is disposed at a position more separated from the carriage guide shaft 44 than from a position of the gravity center C of the carriage 32, and thereby it is possible to detect a minute posture change of the carriage 32 which is impossible to be detected in a case where the gyro sensor 39 is disposed at a position other than the position described above.

In this specification, the "gravity center" includes any concepts of a physical gravity center and a geometrical gravity center.

Position in Y-Axis Direction (Main Scanning Direction)

The gyro sensor 39 is disposed at the "substantially center position" of the carriage 32 as illustrated in FIG. 8 in the Y-axis direction (main scanning direction). Here, the "substantially center position" means a practically center position with consideration for a variation in disposing position of the gyro sensor 39 due to a manufacturing error, for example.

Here, the nozzle N as the ejection opening of the ink is formed at the "substantially center position" of the nozzle plate 240. Hence, it is possible to detect the posture change at a position closer to the nozzle N as the ejection opening of the like of the carriage 32, compared to a case where the gyro sensor 39 is provided at a position other than the "substantially center position.

In addition, since the "substantially center position" of the nozzle plate 240 is a position that is separated from both end portions of the carriage 32 in the Y-axis direction (main scanning direction) by a "substantially equal distance", the posture change is stably detected when the posture change of the carriage 32 occurs with any end position as a fulcrum.

On the other hand, in a case where the gyro sensor 39 is positioned at an end portion or in the vicinity of the carriage 32 in the Y-axis direction, (almost) no posture change is detected when the end portion is the fulcrum of the posture change.

In a case where the gyro sensor 39 is provided at a position closer to any end portion in the Y-axis direction, the posture change is detected to be small when a closer end portion is the fulcrum of the posture change even in a case of the same extent of the change amount of the posture change, and the posture change is detected to be large when a farther end portion is the fulcrum of the posture change.

As described above, the gyro sensor 39 is provided at the "substantially center position" of the carriage 32, and thereby a "change in distance between the nozzle N and the recording paper P", which directly influences the image-forming accuracy, can be detected with higher accuracy.

Position in Z-Axis Direction (Normal Direction to Nozzle Plate 240)

The gyro sensor 39 is provided, in the Z-axis direction (normal direction to the nozzle plate 240), at a position at which the shortest distance between the gyro sensor 39 and the nozzle plate 240 is shorter than the shortest distance between the gravity center C of the carriage 32 and the nozzle plate 240 as illustrated in FIG. 9. Consequently, the gyro sensor 39 is positioned at a position closer to the nozzle plate 240 than to a position of the gravity center C of the carriage 32.

Here, since the nozzle N as the ejection opening of the ink is formed in the nozzle plate 240, the gyro sensor 39 is provided at a position closer to the nozzle plate 240 than to the position of the gravity center C of the carriage 32, and thereby the posture change at the position closer to the nozzle N is detected with higher accuracy than in a case where the gyro sensor 39 is provided at a position other than the position closer to the nozzle. Consequently, it is possible to detect the "change in distance between the nozzle N and the recording paper P" with high accuracy.

More preferably, the gyro sensor 39 is provided between a mounting portion of the ink cartridge 31 and the nozzle plate 240 in the Z-axis direction (normal direction to the nozzle plate 240).

Posture Change Detecting Timing by Gyro Sensor 39

The gyro sensor 39 performs a detection operation of the posture change of the carriage 32 at timing when the ink is not ejected from the ejector 35 of the head unit 30 based on the printing control signal CtrP that is input from the controller 6. For example, the carriage 32 performs scanning along the carriage guide shaft 44 in the Y-axis direction before printing (a state in which the ink is ejected from the ejectors 35). In this case, the gyro sensor 39 performs detection of the posture change of the carriage 32, and the posture-change amount information is input to the controller 6 as described above. The posture-change amount information input to the controller 6 is transmitted to the storage unit 62 in the controller 6.

Then, the CPU 61 controls the head driver 50 based on the posture-change amount information so as to cancel the "displacement of the landing position of the ink" due to the "posture change of the carriage 32" based on the posture-change amount information input (stored) in the storage unit 62. In other words, the ink jet printer 1 according to the embodiment executes the printing in a state in which correction of the posture change of the carriage 32 has been performed.

The detection of the posture change by the gyro sensor 39 is not limited to the timing before the printing and may be executed during a printing job. In this case, the ejection of the ink is stopped while the ink jet printer 1 performs the printing, and the carriage 32 performs scanning along the carriage guide shaft 44 in the Y-axis direction while the ejection of the ink is stopped. Then, the posture-change amount information detected by the gyro sensor 39 is transmitted to the storage unit 62, and the printing is resumed in a state in which the correction of the posture change of the carriage 32 has been performed.

As described above, according to the embodiment, the gyro sensor 39 performs the detection operation of the posture change of the carriage 32 at timing when the ink is not ejected from the ejector 35 of the head unit 30. Then, the ink ejection is performed such that the influence of the posture change of the carriage 32 is canceled. Therefore, the ink jet printer 1 according to the embodiment is capable of suppressing the influence of the electromagnetic noise due to the ink ejection signal. Since it is possible to suppress the influence of the electromagnetic noise due to the ink ejection signal, the gyro sensor 39 according to the embodiment is capable of enhancing the detection accuracy of the posture change of the carriage 32 which causes the displacement of the landing position of the ink. Specifically, since rotational displacement around a normal line to the nozzle plate 240 (recording paper P) and horizontal displacement to the nozzle plate 240 and the recording paper P are detected with high accuracy, it is possible to control the ejection so as to cancel the displacements.

In other words, in the ink jet printer 1 according to the embodiment, it is possible to increase the number of nozzles N, and thus it is possible to suppress degradation of high-quality printing or high-speed printing. Furthermore, in the ink jet printer 1 according to the embodiment, the ink ejection as a result of the correction of the posture change of the carriage 32 is prepared before a printing operation, and thus there is no need to perform a high-speed process, compared to a case where correction is performed during the printing operation. In other words, the ink jet printer 1 according to the embodiment does not need to include hardware for realizing a high-speed correction process of the ink ejection during the printing operation. In addition, correction of the posture change is performed before the printing operation, and thereby the printing operation is not interrupted when the posture change of the carriage 32 is detected and the ink ejection is corrected. Therefore, it is possible to perform higher-speed printing.

In addition, the gyro sensor 39 is disposed at the "specific position" described above, and thereby it is possible to provide the ink jet printer 1 that is capable of detecting the posture change of the carriage 32 which causes the displacement of the landing position of the ink with high accuracy.

In other words, it is possible to detect a small posture change of the carriage 32 which is impossible to be detected in a configuration in which the gyro sensor 39 is disposed at a position other than the "specific position" described above, and it is possible to detect the posture change at a position closer to the nozzle N as the ejection opening of the ink.

Hence, it is possible to detect the posture change of the carriage 32 with high accuracy, and it is possible to perform the high-quality printing by highly accurate ejection control based on the corresponding detection result.

The gyro sensor 39 that is provided in the moving unit 3 is not limited to one gyro sensor, and it may be needless to say that two or more gyro sensors 39 are provided in the moving unit 3. Consequently, it is possible to detect the posture change of the carriage 32 with high accuracy.

B. Modification Example

The embodiments described above can be modified in various ways. Specific modification examples are described as follows. Two or more embodiments arbitrarily selected from above can be appropriately combined within a range in which the embodiments are compatible with each other.

Hereinafter, a difference from any embodiment described above will be described in order to avoid repeating the description. The difference is a part of the carriage 32 that is supported by the carriage guide shaft 44.

As described above, the "specific position", at which the gyro sensor 39 is provided, is set by a part in which the carriage 32 is supported by the carriage guide shaft 44 and the position of the gravity center C of the carriage 32.

Figure 10:
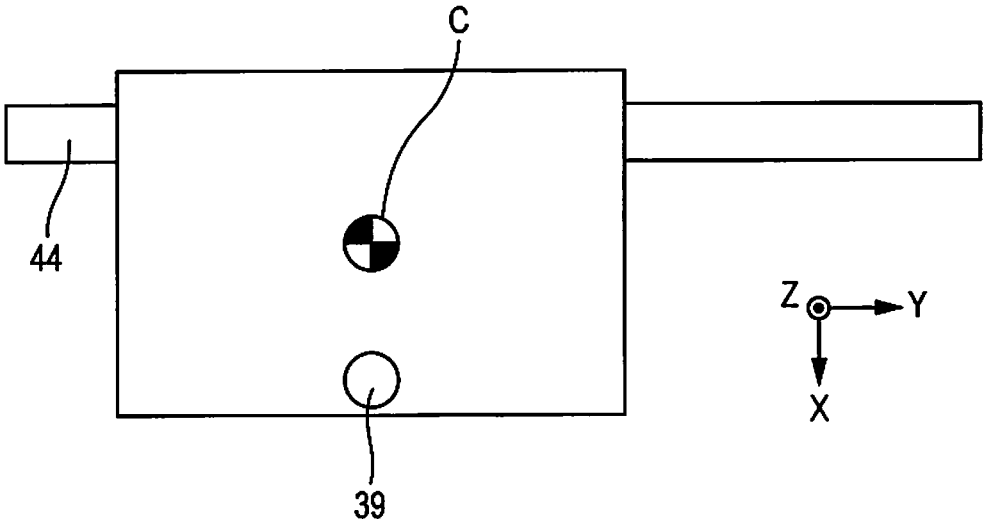
FIG. 10 is a schematic view illustrating a disposing position of a gyro sensor in an ink jet printer according to a modification example.
Figure 11:
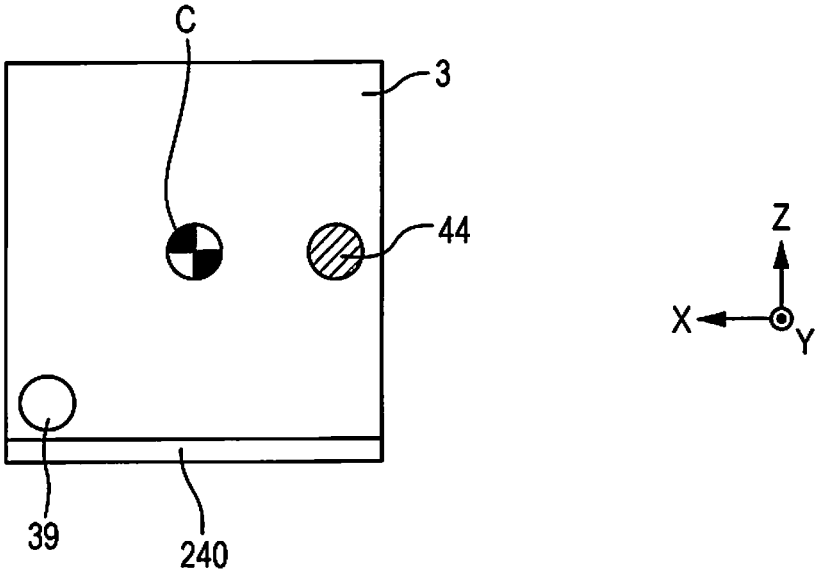
FIG. 11 is a schematic view illustrating the disposing position of the gyro sensor in the ink jet printer according to the modification example.

In the ink jet printer 1 according to the modification example, as illustrated in FIGS. 10 and 11, the substantially center part of the carriage 32 in the Z-axis direction, in the vicinity of a rear end (end in a −X direction) of the carriage 32 in the X-axis direction, is supported by the carriage guide shaft 44.

In this case, the position that satisfies the condition of the "specific position" described above is the vicinity of a front end (end in a +X direction) of the carriage 32 in the X-axis direction, is the substantially center part of the carriage 32 in the Y-axis direction, and is the vicinity of a lower end (end in the −Z direction) of the carriage 32 in the Z-axis direction.

C. Applicable Example

First Applicable Example

In the embodiments and the modification example described above, the ink jet printer 1 includes an example achieved by applying the invention to the liquid ejecting apparatus (ink jet printer 1) which is called an on-carriage type. This example is made in that the posture change of the carriage easily occurs due to various factors because the ink cartridge is mounted on the carriage in the on-carriage type, and the moving unit has a heavy weight.

However, an application target of the invention is not limited to the on-carriage type of ink jet printer. For example, the invention can also be applied to an ink jet printer that is called an off-carriage type. In the off-carriage type of ink jet printer, the ink cartridge is installed at a position other than the carriage including the ejector, the ink cartridge and the ejector are connected to each other by a tube, for example, and the ink is supplied to the ejector from the ink cartridge through the tube. Even in such a configuration, application of any embodiment and the modification example described above is not hindered at all.

What is claimed is:

1. A liquid ejecting apparatus comprising:

a support that extends in a second direction intersecting a first direction in which a printing medium is transported;

a carriage that is connected to the support and is movable in the second direction;

an ejector that is provided in the carriage and configured to eject a liquid to the printing medium; and a detector that is provided in the carriage and configured to detect a change in posture of the carriage and to output posture-change amount information based on the change in posture of the carriage; and a controller configured to generate a printing control signal, output the printing control signal to the ejector to control ejection of the liquid from the ejector, output the printing control signal to the detector so that the detector detects the change in posture of the carriage while the carriage moves in the second direction when the liquid is not ejected from the ejector based on the printing control signal, and correct ejection of the liquid based on the posture-change amount information.

2. The liquid ejecting apparatus according to claim 1, wherein the detector is configured to detect the change in posture of the carriage, before the liquid is ejected to the printing medium.

3. The liquid ejecting apparatus according to claim 1, wherein the ejector has a piezoelectric element configured to perform an operation of ejecting the liquid, and the controller is configured to change at least one of timing of the ejection, a speed of a liquid droplet related to the ejection, an amount of one liquid droplet related to the ejection, a total amount of liquid droplets related to the ejection, the ejector that performs the ejection, and voltage that is applied to the piezoelectric element, based on the posture-change amount information from the detector.

4. The liquid ejecting apparatus according to claim 1, wherein the detector is provided at a position at which a shortest distance between the detector and the support is longer than a shortest distance between a gravity center of the carriage and the support.

5. The liquid ejecting apparatus according to claim 1, wherein the ejector has a nozzle plate provided with an ejection opening for ejecting the liquid by the ejector, and wherein the detector is provided at a position at which a shortest distance between the detector and the nozzle plate is shorter than a shortest distance between a gravity center of the carriage and the nozzle plate.

6. A moving unit comprising:

a carriage that is movable in a second direction intersecting a first direction in which a printing medium is transported;

an ejector that is provided in the carriage and configured to eject a liquid to the printing medium; and a detector that is provided in the carriage and configured to detect a change in posture of the carriage and to output posture-change amount information based on the change in posture of the carriage; and a controller configured to generate a printing control signal, output the printing control signal to the ejector to control ejection of the liquid from the ejector, output the printing control signal to the detector so that the detector detects the change in posture of the carriage while the carriage moves in the second direction when the liquid is not ejected from the ejector based on the printing control signal, and correct ejection of the liquid based on the posture-change amount information.

* * * * *